United States Patent [19]

Roberson

[11] Patent Number: 4,970,759

[45] Date of Patent: Nov. 20, 1990

[54] TEXTILE FIBER PROCESSING APPARATUS AND METHOD

[76] Inventor: James H. Roberson, 10 Ashwood Ave., Greenville, S.C. 29607

[21] Appl. No.: 339,058

[22] Filed: Apr. 14, 1989

[51] Int. Cl.[5] ..... D01G 9/08; D01G 15/40

[52] U.S. Cl. ..... 19/105; 19/98; 19/296; 19/204; 19/65 R; 19/65 A

[58] Field of Search ..... 19/65 R, 65 A, 105, 19/240

[56] References Cited

U.S. PATENT DOCUMENTS

| | | | |
|---|---|---|---|
| 3,567,288 | 3/1971 | Wood | 19/65 A X |
| 4,136,911 | 1/1979 | Husges | 19/105 X |
| 4,219,289 | 8/1980 | Trützschler | 19/105 X |
| 4,403,374 | 9/1983 | Wood | 19/105 |
| 4,657,444 | 4/1987 | Pinto | 19/105 X |
| 4,811,463 | 3/1989 | Leifeld | 19/105 |

*Primary Examiner*—Werner H. Schroeder
*Assistant Examiner*—Ismael Izaguirre
*Attorney, Agent, or Firm*—Cort Flint

[57] ABSTRACT

Apparatus for processing textile fibers is disclosed which includes a carding machine (14) and a batt former (A). Batt former (A) includes an air circulation loop which includes a plenum (B), fiber compacting chamber (C), air separating means (72, 74), acceleration channel (30), duct (46), and fan blower (54). Fan blower (54) has an adjustable angle of incidence "a"to direct a jet of fiber-laden air into plenum (B) against a splash plate (66) to cause fibers to be deposited in fiber compacting chamber (C) in a cross-directional profile so that fibers at side walls of the plenum may have increased residence time in the fiber compacting chamber compensating for side wall friction. A first separated air flow (5) is divided by side friction. A first separated air flow (5) is divided by side channels (92*a*, 92*b*) and combined with a second air flow (4) to form supercharged air flow regions at the sides of the air flow passing through acceleration channel (30). This accelerated air flow with supercharged side regions creates an air knife in combination with plate (26) which passes through teeth (28*a*) of opening roll (28) to doff fibers from the opening roll. In this manner, efficient doffing across a working width of opening roll (28) is achieved with minimum energy from fan (54). Fiber batt (10) is discharged from fiber compacting chamber (C) having a cross-directional profile which eliminates light edges on the web carded by carding machine (14). Alternate fiber supply modules may be attched to a supply inlet (22) of opening roll (28) due to the static pressure at the supply inlet and static pressure (P3) being either generally equal to, or less than, ambient. The air circulation loop provides a high static pressure (P1) at the fiber compacting chamber for enhanced fiber compaction without interference with the supply of fiber into the inlet (22).

76 Claims, 7 Drawing Sheets

DENSITY PROFILES

TEXTILE FIBER PROCESSING APPARATUS AND METHOD

BACKGROUND OF THE INVENTION

The invention relates to the conditioning and feeding of textile fibers to an associated textile processing machine, and particularly to the pneumatic working of textile fibers inside a batt forming machine and the like.

In the past, many devices have been proposed for handling textile fibers in the processes of opening, cleaning, and feeding the fibers.

Fiber is delivered to textile mills in the form of highly compressed and densely packed bales. Within such hard bales the individual fibers are tightly matted, entangled and generally knotted together. Before these fibers can be made into an acceptable textile product, they must be progressively loosened, step-by-step, and ultimately separated to a fiber-to-fiber state. Such separation of the fibers is commonly called "opening" the fibers.

Great care must be exercised in the manner by which the fibers are opened or, otherwise, they can be curled, bruised, broken, or drawn into very tight tiny knots called "neps". Fibers in any of these conditions seriously degrade the quality of the textile product which can be formed. The requirement that the individual fibers must not be degraded during their processing, has posed serious limitations on the techniques available to textile machine designers as to how they can process the fibers from the hard bales down to the individual fiber-to-fiber state.

The well known textile carding machine is often used as the last process to provide the individual fiber-to-fiber separation which is required. The product taken from the doffer cylinder of a carding machine is a very fine web of fibers, which has the visual appearance that one might see if several spider webs were laminated atop each other—hence the name, "carded web". A carded web is extremely delicate and easily damaged because the only forces holding the web together is the natural curliness or crimp of the individual fiber ends which are loosely hooking on to one another. A carded web is not nearly as strong as a spider's web, because the latter has a chemical bonding at every point where the strands cross. For this reason, how one handles a carded web is extremely critical.

The Textile Industry can be broken down into two major groups the non-woven segment and the yarn making segment. In the non-woven segment, the webs of several carding machines are often laminated and the individual fibers bonded together to form the final product. Such bonding may be accomplished by either chemical means (such as latex binders, thermal fusion, etc.), or by physical interlocking of the fibers (such as by needle punching, etc.). To the non-wovens industry, both the cross-direction weight per unit area and the running-direction weight per unit area of the webs delivered by carding machines are extremely critical because such weights govern the quality of their end-product. Furthermore, since web spreading devices are often used immediately downstream of a line of carding machines, to spread the laminated webs even wider, web weight inconsistencies can adversely affect the effectiveness of such spreading devices and the subsequent processing steps.

The yarn making segment of the industry usually gathers the carded web into rope-like form which is called a "sliver". The sliver is generally drawn and spun into a yarn which is formed into a fabric by either knitting or weaving of the yarns. Because the ultimate quality of such fabrics is governed by the uniformity along the lengths of the strands of the yarns used, yarn makers have usually been more concerned with the running-direction weight uniformity of the carded web than they have been with the cross-directional web weight profile. Clearly, to universally meet the particular requirements of both segments of the textile industry, the webs produced by a carding machine need to have good and controlled weight properties in both the running-direction and the cross-direction.

For a given degree of carding quality, there are two principal factors which presently restrict the maximum production rate obtainable from conventional carding machines. First, how well the tiny fiber bundles have been loosened and separated before they are presented to the card's main cylinder. Second, the cross-direction density profile of the very thin sheet of fibers presented to the card's main cylinder. To compensate for the inadequate degree of fiber opening delivered from present day card feeding systems, "high performance" carding machines today often employ either one or two additional licker-in cylinders in series with the single licker-in cylinder which has been traditionally used on conventional carding machines. For reasons discussed below, such additional licker-ins do not provide the results expected or needed. Consequently, such carding machines cannot run at the full production rate potential which can be achieved.

The cross-directional density profile of the sheet of fibers presented to a card's main cylinder is important to high production carding for several reasons. First, if the cross-direction density profile has a uniform state, such as shown by FIG. 5, then the main carding cylinder carries a uniform fiber load across its full width and can run at the optimum or maximum production rate. Unfortunately, the cross-direction density profile of the batt delivered by present day card feeding devices look more like that illustrated by FIG. 4. Consequently, the carding potential across the card's main cylinder is not fully utilized and the production rate is thereby limited. Secondly, the surfaces of licker-in cylinders and main carding cylinders are covered with literally thousands of tiny teeth and both cylinders are run at very high surface speeds. Consequently, windage currents are created where the licker-in cylinder engages with the main carding cylinder to transfer the fibers carried in the teeth of the former cylinder. Such windage currents tend to blow the fibers toward the outside edges of the card at both the point of fiber transfer, and around the "working path" followed by the main cylinder. This results in a condition known as "light selvages", or carded webs which are substantially lighter on their edges than near their center region. At increased production speeds, increased windage currents are also created by the thousands of teeth carried on the surface of the doffing cylinder, which causes the delicate carded web to be blown about more violently after it is taken from the doffer, which causes web breaks.

To eliminate broken webs, modern "high performance" cards are equipped with complicated web gathering devices (such as belts or a plurality of turning wheels) which gathers the web into a sliver before the delicate web can be exposed to the effects of the doffer windage. However, such web shielding mechanisms are not without their own particular set of problems because they tend to accumulate a build-up of waxes or fiber spin finishes which picks at and snags portions of the tender web, which causes "end breaks" due to wrap-ups. Because they do not utilize a sliver, non-woven applications must use the full width web delivered by the card and, thus, cannot be fitted with such web shielding or gathering devices. Consequently, their current maximum rate of production has been limited by these factors. Therefore, the optimum solution for both non-woven and yarn making manufacturers is to provide a simple means to eliminate "light selvages" and, thereby, obviate the need for the problematical web shielding mechanisms which have heretofore been required to operate carding machines at increased production rates.

As mentioned above, the batts produced by present day card feeding devices have non-optimum cross-directional density profiles, such as shown by FIG. 4. This disadvantage comes about because the friction of the side walls of such card feeding devices dissipates a portion of the energy used to form the batts within their batt forming chambers—irrespective of how the packing work is done, whether by static pressure compaction of the tufts, or by vibrating plate compaction of the tufts, or the combination of both methods. Since side-wall friction cannot be eliminated, the solution is to form batts of fibers in such a way that the effects of sidewall friction are negated.

Another problem faced by modern textile mills is their need to exploit the profits available by operating with reduced inventories. New operational concepts, sometimes referred to as "just-in-time" and "quick response", permits such profits . However, to practice these operational concepts textile mills must have total flexibility as to how they supply fiber to each card in the mill. Then, each card can be quickly changed from one blend or mix to another, in order to match instantaneous production needs. Present day card feeding systems can offer such flexibility only at great capital cost and complexity in the distribution systems which are available.

It is known in the art that resting air may be drawn in from the room environment and accelerated by a fan to form a conveying airstream—which is passed through a fiber opening machine which is generating large tufts and flinging them into such airstream for transport to a downstream batt forming apparatus—which contains a fiber condensing screen to retain such tufts while exhausting the transport air back into the environment. Such art may be seen, for example, by reference to U.S. Pat. Nos. 4,769,873; 4,689,857; 4,462,140; 4,009,803; 3,851,924; 3,851,925; and 4,682,388.

With such devices, the air is used just once to convey fiber and all the energy contained in every pound of transport air, as it is dumped back into the environment, is consequently wasted. Additionally, before such air (large quantities are needed) is suitable to be returned to the room—where humans breath it—it must be properly filtered. It is well known that the frictional losses associated with passing large quantities of air through dense/efficient filter media, and the resulting economic costs, are enormous.

Furthermore, in order to make a first class end-product, it is widely accepted that the weight variation of every square yard of carded web delivered by a carding machine must not vary more than plus or minus three to five grains from the nominal or mean operating value. As a frame of reference, such a tight weight tolerance is about equal to the weight of three U.S. Postage Stamps, each measuring about $\frac{7}{8}$ inch$\times$1 inch. It is very difficult to even measure such standards in a normal operating environment, because vibrating floors, the air currents from the room air conditioning system, and even persons breathing near the sensitive scales needed, all affect their weighing accuracy. Since the carded webs from "high performance" cards are spewing forth at the rate of about 2 to 6 linear yards per second, it is obvious that a crude simplistic approach—like, just opening some fibers and blowing them into box—is incapable of meeting modern production standards. To properly address the problems of producing a very high quality carded web, having the desired weight profiles, and doing so with the minimum expenditure of energy, requires considerable attention to every detail of the various processing steps involved along the way.

For the above mentioned reasons, and others which will become apparent below, such art as cited above is unsuitable to meet the objects of the present invention.

It is known in the art (for example, U.S. Pat. No. 4,520,531) that the cross-directional density profile of a batt delivered by a batt former may be altered through the use of a plurality of damper plates, positioned outside of a fiber condensing screen, to vary the amount of air flowing through different portions of the screen and, thereby, guide tufts to the general regions desired. Such art also teaches that a plurality of wedge shaped members may be actuated within an airstream to modulate the airflow passing through various portions of a fiber condensing screen, and/or that a plurality of blocking members may be moved in or out to vary the cross-sectional airflow area in order to direct various portions of the airflow through different zones of such fiber condensing screen. All of the above mentioned movable members, to alter the airflow through various regions of the fiber condensing screen, are operated in response to a plurality of sensors, disposed downstream of the batt forming apparatus, which feeds back control signals to a plurality of actuator means. The theory behind such devices is quite simple, where the air goes, tufts will later go. The art usually over-simplifies the theory and forgets several key scientific facts. First, tufts flung from the tips of the pins, on fast moving opener rolls, possess great momentum in the direction they were travelling at the point of release—usually downward. Secondly, to move a tuft side-ways, relative to the direction of travel, requires the application of a side-ways force and time, and time requires travel distance. Thirdly, the art usually places the distance, between the opener roll and the top of the column of stock in the batt forming chamber, at something between 16 to 24 inches (due to practical ceiling height limitations). Consequently, there is precious little time for a fast travelling tuft to do much side-ways movement. Therefore, such pneumatic prior art devices often fail to measure up to performance expectations. Due to their sheer complexity and for other reasons which will become apparent below these type systems are unsuitable to meet the objects of the present invention.

It is known in the art (for example, U.S. Pat. No. 3,787,093) that a plurality of fan wheels may be placed inside a batt former to pressurize the column of stock contained within such batt former. The fan wheels draw tufts and fibers from a distribution system and fling them downward into the batt forming region beneath the fan wheels. The prior art teaches that a guide member or members may be slidably mounted or pivotably mounted within the batt former, in order to attempt to control the air currents and/or tufts flowing around therein. Each pound of common textile fibers contains literally millions of tiny fibers—each having a diameter which is much finer than a human hair. For batt formers operating at production rates of 100 to 200 pounds per hour, over a billion fibers flows through such devices in just a short period. Whenever slidable or pivotably mounted plates are inserted within a highly pressurized batt forming device, operating clearances must always be provided between the movable plates and the machine walls. The billions of tiny fibers flowing are constantly "looking" for joints, cracks, crevices in which to become lodged. With such high numbers present, the mathematical probability that a snag point will be found is quite high. Once a single fiber becomes lodged, others aerodynamically spin on it, due to turbulence and swirls, until ropes are formed. The ropes flop around and interfere with the proper distribution of tufts and air currents within such devices. Additionally, when such tightly spun ropes do occasionally break loose, they are very detrimental to the carded quality of the product. These ropes have been known to choke down and even destroy carding machines. It is well known that centrifugal fans are inefficient devices from an energy consumption point of view. Therefore, the required use of two or more such fans within a batt former is particularly wasteful of energy. For these and other reasons which will become apparent below, this prior art has serious operating disadvantages.

It is known in the art (for examples, U.S. Pat. Nos. 3,400,518 and 3,708,210) that fiber condensing screens may be constructed by the parallel alignment of a plurality of flat bars (long side facing the tufts), or T-shaped bars, or L-shaped bars. The bars are disposed so that spacing gaps between each of the bars form a plurality of vertical slots. The slots allow the passage of air into an exhaust chamber, from a fiber condensing chamber, while restraining the tufts deposited within the fiber condensing chamber. It is also known in the art (for example, U.S. Pat. No. 3,482,883) that another type of fiber condensing screen may be constructed by placing a plurality of thin rods parallel to each other, so that air exhaust slots exist in the spacing gaps between each of the thin rods. Such prior art screens have two common characteristics. First, the thickness of the screens (or the depth of the slots) measured away from the tufts contained within the fiber condensing chamber, is quite thin. Secondly, each of the aforementioned air slots results in an abrupt "flow area" enlargement upon entering the air exhaust chamber. Anytime air passing through a slot-like orifice experiences an abrupt "flow area" enlargement, swirls, eddies and turbulence results. Since many of the tiny hair-like fibers also project through the shallow (thin) slots, while the tufts (from which the projecting fibers are attached) are restrained within the condensing chamber, the swirls in the exhaust chamber causes the projected fibers to be aerodynamically spun and twisted together to form highly detrimental neps. This is a serious operating disadvantage.

It is known in the art that a hopper feeder may be used to supply fiber to a carding machine and such art may be seen, for example, by reference to U.S. Pat. Nos. 3,070,847; 3,738,476; 3,548,461; and 3,562,866. With such art, the objective is to provide a fairly uniform cross-direction density profile in the batts they ultimately form. They attempt to accomplish this by rolling and tumbling a ball of stock contained within the hopper, by an upward moving pinned apron, while the pinned apron extracts tufts from the rolling ball which are deposited into a batt forming chute located down stream. Because the aprons of such devices are comprised of slats loaded with pins which are usually spaced apart about one inch (25 mm), the fiber separation potential of the devices is severely limited. Again, a pound of common textile fibers contains at least one million fibers. If a pound is fortunate enough to be engaged by as many as 1,000 pins (unlikely), this means that the smallest tuft produced will itself contain over 1,000 fibers. These large tufts are unsuitable for high production, high quality carding. Additionally, because of side wall friction in the batt forming chamber, hopper feeders produce batts which have a undesirable cross-directional density profile such as that illustrated in FIG. 4. For these and other reasons which will become apparent below, such art is unsuitable to meet the objects of the present invention.

When processing certain types of fibers (for example, cotton which must pass through elaborate cleaning steps before it is suitable for presentation to a carding machine), it is sometimes preferable to supply fiber to a group of cards from a central supply point. Usually a pneumatic transport system is used which deposits fiber into batt forming devices located at each of the various carding machines in a line. In order to attempt to achieve a fairly uniform cross-directional density profile in the batts delivered by the batt formers of such systems, it is known in the art to arrange the cards of a processing line in an "end-to-end" fashion and flow tufts "longitudinally" down a main transport duct, which passes over the cards in their running-direction. This art may be seen, for example, by reference to U.S. Pat. Nos. 3,029,477; 3,300,817; 3,414,330; 3,112,139; 3,326,609; 3,552,800 and Re. U.S. Pat. No. 27,967. Here the theory is that a long shallow transport duct, that is the full width of the batt formers, will cause the tufts to be distributed evenly across the widths of the various batt formers as the tufts are deposited therein. However, because of the effects of sidewall friction in the batt formers, they produce a batt having the undesirable cross-directional density profile illustrated by FIG. 4. Additionally, the "longitudinal" or "end-to-end" arrangement of carding machines is non-optimum for many yarn making applications. Carding machines are about 3 times as long as they are wide. Consequently, the "work-path" which must be travelled by a card tender or operator, doffing cans of sliver and transporting them to a subsequent process, is much longer than if the line of cards can be arranged "side-by-side". Because of these reasons and others which will become apparent below, such art is not suitable to meet the objects of the present invention.

Arranging a line of cards "side-by-side" and using a "transverse" method of supplying fiber to the various cards by flowing the large tufts from a central supply point "crosswise", with respect to the running-direction of the cards, is preferable in most yarn making applications. This art can be seen, for example, by reference to British Patent No. 1,113,033 and U.S. Pat. Nos. 3,473,848; 2,964,802; 3,474,501; 4,476,611; 4,136,911; 3,450,439; 3,667,087; 3,145,426; 3,903,570; and 3,896,523.

Because the stock is flowing first in one direction and then must abruptly change direction, this method of supplying fiber to cards is fraught with many special problems and disadvantages.

Classic examples of pneumatically supplied batt forming devices are disclosed in U.S. Pat. Nos. 4,656,694 and 4,779,310; the latter of which is directed to a control device for reducing the weight errors which are often caused by prior art batt formers. Generally, in this type device, fibrous stock, in large tuftular form, is pneumatically conveyed from a central supply point by a large powerful fan. The fan is connected to a main transport duct which may pass over a group of batt formation machines (Prior art FIGS. 10*a* and 10*b*). The combined actions of gravity and the bleeding of a portion of the main transport air out through screens, disposed along the front and rear walls of the upper fiber reserve chute causes some of the tufts to be extracted from the main transport duct and deposited into the upper reserve chute. A high positive static pressure P5 operates atop the column of fibers in the reserve chute and compresses them downward against a feed roll between the reserve chute and a batt formation chamber.

With the flow down the main transport duct (as shown) the momentum of the fast travelling, coarsely opened tufts causes them to be piled against the left sidewall of the reserve chute (Prior art FIG. 10*b*). This causes the cross-directional density profile of the batt "seen" by the feed roll to take on the appearance illustrated in prior art FIG. 10*c*. This density profile is "lighter" on each side because of the sidewall friction existing in the reserve chute, and skewed off-center due to the momentum of the deposited tufts.

The feed roll presents stock to an opener roll which plucks tufts therefrom and, primarily by centrifugal forces, doffs itself of such tufts by flinging them downward into the bottom batt formation chute. There, a high positive static pressure P6 compresses the tufts to form a batt which is fed outward and downward to a conventional carding machine. Static pressure P6 is caused by a fan, which pressurizes a plenum chamber to attempt to cause a fairly uniform velocity sheet of air to exit through an orifice slot located at the bottom of the plenum chamber. The exiting sheet of air flows generally along a guidesheet and down into the bottom chamber. At this point, the airflow is exhausted through front and rear screens and, is returned to the inlet of the fan.

In theory, any deficiency of tufts—to block off the screens in the formation chamber—will be filled by tufts deposited thereon by the sheet of guide air flowing into the bottom chamber—because the airflow should be greatest in the regions of screens having the most "open" area. This reliance on passive control means to adjust the cross-directional density profile is not totally effective. The resulting density profile of the batt leaving the formation chamber takes on the appearance illustrated by prior art FIG. 10*d*. That is, it is still skewed in the direction of flow of tufts in the main transport duct, but is somewhat improved symmetrically over the batt leaving the upper reserve chute. It is still "light" on the edges. The "lighter" edges result, of course, because of the sidewalls friction acting on the fibers in the bottom chamber, and the fact that the cross-directional velocity profile in the sheet of guide air is likewise adversely affected by the sidewall friction of the batt forming machine.

A static pressure, almost equal in value to P6, exists in the region between the opener roll and feed roll. This static pressure tends to resist the downward flow of the fibers in the stock column and must be counteracted by having an even higher positive static pressure P5 in the main transport duct. There is a practical upper limit as to how high static pressure P5 can be raised, because the increased potential energy level can cause severe chokes, or fiber jams, in the main transport duct. This happens whenever any pressure imbalance exists between the batt formation machine shown and the other batt formation machines which are operating in parallel, because they are all connected to the same transport duct. Such feeding systems have a well known propensity to choke because of such pressure balance sensitivity.

Since such feeding systems are usually employed as a group of batt formation machines connected to the same transport duct, the static pressures developed by their respective individual fans tends to work against, or "fight", the main supply fan which is propelling the stock down the main transport duct. This is a serious misuse of energy, and aggravates the pressure balance sensitivity of such feeding systems because there are frequent occasions when one or more of the batt formers in a feed line must be stopped; because of either a routine "end down" (web breakage) or maintenance being performed on one of the carding machines in the line. Furthermore, since there is a practical upper limit imposed on pressure P5 there is, by consequence, corresponding upper limits imposed also on the pressures P6 operating in the various batt formers. This deprives such prior art systems from the opportunity to be able to pack the batts being formed with an optimum higher pressure. Still further, pressure P5 is constantly fluctuating up and down as the various screens of the various reserve chambers become covered or "blocked" with tufts, as stock flow is intermittently started and stopped from the central feeding point, and as the "back-pressure" from the filtration system fluctuates due to "loading" and "stripping" of the filter media. Fluctuations in P5 are immediately reflected in fluctuations in P6, which is working against it, and the results are adverse fluctuations in the densities of the batts leaving the batt formation chutes. It is primarily to compensate for these undesirable pressure fluctuations and interactions, that elaborate control systems such as disclosed in U.S. Pat. No. 4,779,310 have been proposed.

Classic opener rolls in such feed systems are usually constructed using between 4 to 8 pinned bars, disposed linearly across the width of the opener roll. Each pinned bar is populated with pins spaced apart approximately 1 inch (25 mm) along their length. Assuming the maximum of 8 pin bars is used, and a typical opening roll diameter of 10 inches, and a nominal 38 inches working width opening roll, this computes to a maximum "point density" of about 0.2546 points per square inch of working surface on the opening roll. Since the primary doffing mechanism consists of centrifugal forces flinging off the tufts, a higher pin density over the surface of opener roll does not work properly because the size of the tufts becomes so small that the centrifugal forces become less operative. Likewise, the angle of attack of the pins on the pinned bars cannot be too aggressive toward the fibers because of the difficulty in doffing the tufts from the pins. It is noteworthy that in prior art FIG. 10*a*, the sheet of air flowing along the guide plate is placed at a significant distance off the tips of the pins of the opening roll. These factors all limit the degree of fiber-to-fiber separation possible with the prior art.

Thus, the classic prior art suffers from the adverse effects of sidewall friction, the reduced potential for fiber-to-fiber separation, the adverse effects of pressure sensitivity on the reliable operation of the stock distribution system, and a serious static pressure limitation imposed on the value (non-optimum) which may used in the bottom batt formation chamber to compress the tufts therein.

Accordingly, an object of the invention is to provide a textile apparatus and method for increasing the fiber openness and separation during the processing of textile fibers.

Another object of the invention is to provide a textile apparatus and method wherein the cross-direction density profile of fibers across a batt or sheet of fibers is accurately controlled.

Another object of the invention is to provide a textile apparatus and method which provide total flexibility as to the plying of fibers to associated textile machinery and processes.

Another object of the invention is to provide a simple and efficient textile feeding module which may be universally adapted to accept fibers from any type of source of supply.

Another object of the present invention is to provide a batt forming apparatus which is suitable for receiving fibers from either a hopper feeder (permitting individual card-to-card supply flexibility), or alternatively being connected, as one of a group of batt formers, to a common feeding point (so that all may be supplied from the same source), and which may be easily and quickly switched from one supply mode to the other, so that the textile industry can more readily exploit the profit opportunities offered by the "just-in-time" and "quick response" manufacturing concepts.

Another object of the present invention is to provide a batt forming apparatus which may utilize a very high static pressure in its batt forming compaction operation but which does not interfere with the flow of stock into the batt forming apparatus, irrespective of the mode of supply.

Still another object of the present invention is to provide a textile apparatus and method by which fibrous tufts may be highly opened, or separated to an almost fiber-to-fiber state, by an opening roll, which may contain on its surface a very large number of teeth per unit area and such teeth may be positioned to present a high angle of attack toward the fibers.

Another object is to provide an efficient means to doff the fibers impaled on the teeth of such an opening roll.

Yet another object of the invention is to provide a fluidized mixture, of highly opened fiber bundles and transport air which causes the fiber to be deposited into a batt forming chamber in such a way that, after being acted upon by a high positive static pressure, a batt having a very high running-direction evenness and a desired cross-directional density profile results.

Another object of the invention is to provide a means of separating the conveying air from the highly opened fibers in such a way that a portion of such air may be advantageously used to efficiently doff an opening roll.

Another object of the invention is to provide an improved carding machine which may be operated at very high production rates without the need for additional licker-in cylinders which have heretofore been necessary in order to achieve a comparable high rate of production.

Another object of the present invention is to provide a means to custom tailor the cross-directional density profile of the batt fed into a carding machine such that the web delivered by the carding machine need not suffer from lighter selvages than the weight of the web near the center of the carding machine so that it can operate at higher speeds without adverse windage effects, and the need for the addition of complex web shielding or collection devices.

Another object of the present invention is to provide an improved carding machine which is universally suited for making either a non-woven web or a sliver, because such card includes a device which custom tailors, in a desired manner, the weight per unit area of the web leaving the carding machine and obviates the need for web gathering devices.

Another object of the present invention is to provide a batt forming apparatus which obviates the need for either complicated external screen damper plates or problematical internal steering plates which have heretofore been necessary in order to vary the cross-directional batt density profile.

Another object of the invention is to provide a means of separating the conveying air from the highly opened fibers in such a way that a portion of such air may be advantageously directed to supercharge the boundary regions near the sidewalls of the batt forming apparatus, so that the velocity profile of the doffing air knife may be optimized and thereby it requires a minimum amount of operating energy.

SUMMARY OF THE INVENTION

The above objectives are accomplished according to the present invention of a batt former having an air circulation loop in which air is recirculated. A fan blower distributes fiber-laden air in a plenum in the loop using an adjustable jet to deposit fibers in a fiber compacting chamber in accordance with a desired cross-directional profile. An air separator at the fiber compacting chamber separates the air flow between front and back air flows to deposit the fibers and create a supercharged air flow below the air separator having increased energy at its side regions. The supercharged air flow is accelerated through a channel and forms an air knife which doffs an opening roll. The opening roll, having been supplied fibers from a fiber supply module, opens the fibers. The supercharged air flows create a velocity profile across an air knife which efficiently doffs fibers across a working width of the opening roll to create the fiber-laden air flow. Advantageously, the fibers are deposited in the fiber compacting means so that the fibers at side walls of the plenum may have increased residence time which compensates for side wall friction. The air circulation loop and fan blower provide a unique static pressure situation in the batt former which allows alternate type fiber supply modules to be attached to an inlet of the fiber opening rolls and enhanced fiber compaction in the batt forming chambers. This is because the static pressure at the supply inlet and at the channel area in which fibers are doffed from the opening roll is nearly equal or less than ambient and does not interfere with the injection of stock at the supply inlet. Further, air, fiber, and other hazardous impurities are prevented from being blown into the room through the opening roll area. The batt former is advantageously combined with a carding machine to feed a compacted fiber batt into the carding machine having such a cross-directional density profile that light edges are eliminated on the carded web produced by the carding machine. By using an opening roll in the batt former having teeth of wire or pins of high density per square inch, increased opening and cleaning of the fibers is possible so that a carded web can be produced more efficiently and at higher speeds.

The present invention is concerned with substantially improving the processes of forming batts and carding textile fibers by permitting conventional carding machines to be utilized and run at superior production rates than heretofore possible, but without their need for additional complex and troublesome machine elements. It is also concerned with producing carded webs which have improved weight properties, both running-direction and cross-direction. It is further concerned with providing a carding machine the capability of being supplied fibrous stock simultaneously from a variety of up-stream processes, depending upon the instantaneous production needs at hand, in order to maximize process flexibility and profitability.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

A construction designed to carry out the invention will hereinafter be described, together with other features thereof.

Figure 1:
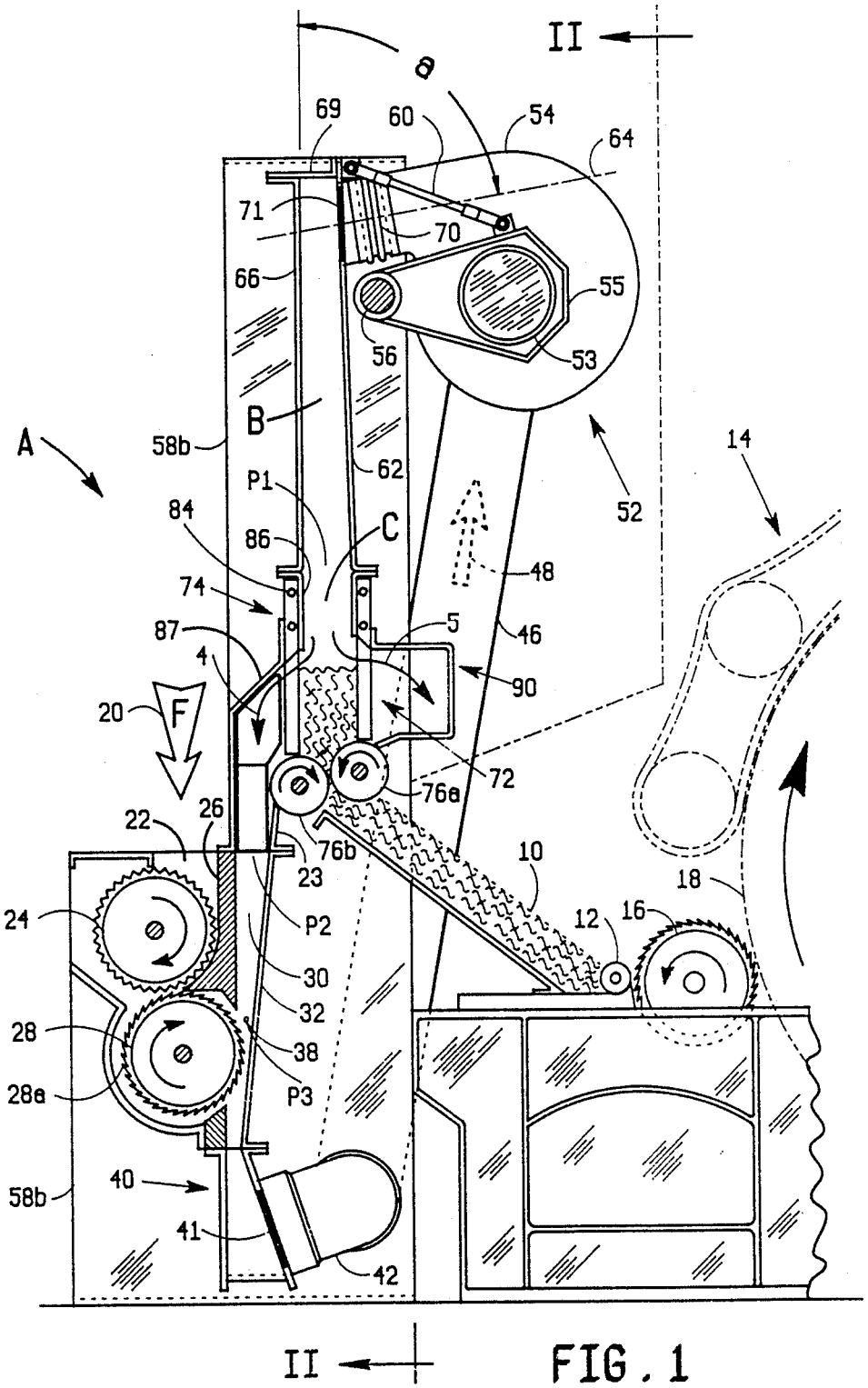
FIG. 1 is a schematic sectional side elevation view, which would appear if the near sidewall 58*a* were removed from the batt former A along the Section Line indicated by Arrows I—I, as shown on FIG. 2.

Referring to FIG. 1, there is shown a batt former, designated generally at A, feeding out a precisely formed batt 10 of fibers to a card feed roll 12 of a carding machine, designated at 14. As a conventional carding machine, it would also utilize at least one licker-in cylinder 16 and at least one main carding cylinder 18, as is well known in the art. As described below, fiber F may be supplied to batt former A in any of several different ways. Fibers enter, in the general location and direction of arrow 20, through an inlet opening 22 (disposed across the width of the machine) and are fed by a primary feed roll 24, which acting in cooperation with a feed plate 26 to form a very tight nip, presents the infed fibers to a fiber opening means which includes an opening roll 28.

Those skilled in the art will recognize that the short nip length provided by the feed roll 24/feed plate 26 combination can be lengthened by substituting a pair of cooperating nipping feed rolls (like, for example, 76*a* and 76*b*) to restrain the fibers fed against the shredding action of opening roll 28, and passing the infed batt through the nip of the roll set. In this case, it may be desirable to modify the "nose" of feed plate 26 in a conventional manner. It is advantageous to be able to practice the present invention with such a modification, because there are instances where one may want to run "long" fibers (say, 3 inches or greater) and short nip lengths can causes such fibers to be damaged. However, with most common lengths of fibers, the feed roll/feed plate combination provides the preferred nip length.

It has been found that the present invention yields the best results when the fibrous mass being processed is reduced to extremely small fiber bundles, e.g. almost the same size fiber bundles as carried on the licker-in cylinders of conventional carding machines. To accomplish this very high degree of fiber separation, the present invention contemplates using a very high number of teeth per unit area disposed around the circumferential working surface of opening roll 28. It is also contemplated to position the teeth 28*a* on opening roll 28 such that they may have a high angle of attack toward the fibers at the nip point. For example, the invention may be practiced using an actual card licker-in cylinder as opening roll 28. Such cylinders are usually clothed with saw teeth wire having a point density of about 20 to 40 points per square inch of working surface—which is about 100 to 400 times the point density of classic opener rolls described above. In the present invention, the term "teeth" means wire or pins. It has been found, according to the present invention, that a range of about 1 to 40 teeth per square inch may be utilized to provide superior opening yet be efficiently doffed.

One of the problems of using such a high tooth density, is the difficulty of doffing the fine web of fibers off of all the teeth. As the teeth 28*a* of opening roll 28 shreds and combs the fibers away for the nip point, the teeth travel in an arcular path with respect to the nip point and this drags the strung-out fibers deeply down into the teeth on the roll. Consequently, the forces of fiber/tooth entanglement exceeds the centrifugal force available to fling the tiny fiber bundles off the opening roll 28, because they have such a low mass when opened to such a high degree. Rolls having a very high tooth density have a well known propensity to "wrap-up" and choke the machine down. This is why the classic opening roll, employed in prior art batt formers, has been provided with only a few rows of coarsely pinned pin bars disposed around their circumference. This doffing problem, in conventional carding machines, is solved by using an even higher tooth density on the main carding cylinder and operating it at a higher surface speed than the licker-in cylinder, so that the fibers can be literally stripped out of the teeth of the latter by a mechanical action.

In batt former A, channel means includes a converging acceleration channel 30 formed by a surface of feed plate 26, a surface of a plate 32 and two side plates 58*a* and 58*b*. Acceleration channel 30 is used to accelerate the recirculating airstream to a very high velocity, so that it can be used as an air knife to cut the web of fibers out of teeth 28*a* of opening roll 28. The doffing action begins at a line 38, which runs across the width of batt former A, at which line it is desired that the velocity of the air knife be at least equal to the surface speed of the teeth on opening roll 28. The doffed web, entrained in the air knife, becomes a fluidized mixture which flows downward into a transition piece, shown generally at 40.

Figure 2:
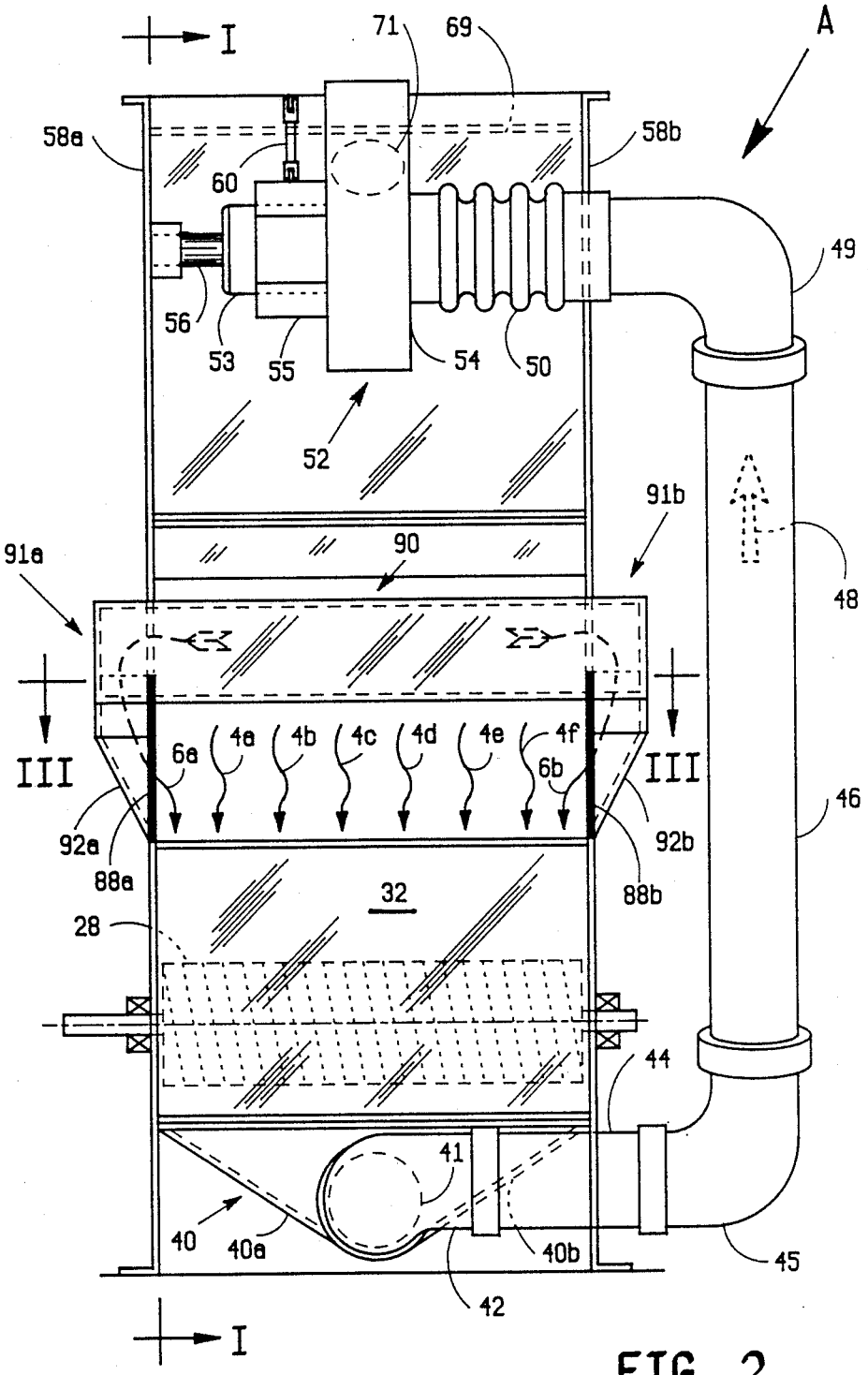
FIG. 2 represents a schematic frontal elevation view of the batt former A, taken from the carding machine 14, in the direction indicated by Section Line Arrows II—II. For the purpose of clarity, the fibrous batt 10, the two batt feed rolls 76*a* and 76*b*, and forward seal plate 23 have been omitted from FIG. 2.

As can best be seen in FIG. 2, duct means includes a transition piece 40 comprised of two downward converging side plates 40*a* and 40*b* which guides the fluidized mixture generally toward the bottom center of batt former A, where it exits through an outlet hole 41 and enters a first turning elbow 42. The flow continues through a connector pipe 44, a second turning elbow 45, and into riser pipe 46 which directs the flow in a generally upward direction, as indicated by arrow 48. Next, the flow passes through a third elbow 49, through a flexible connector 50 (for example, an accordion rubber hose), and into an air propelling means in the form of a centrifugal blower or fan, shown generally at 52.

The fan wheel (not shown) is affixed to a protruding shaft (not shown) of an electric motor 53, which along with the fan casing 54, is attached to a frame 55 which is pivotably mounted on an axle bar 56. Bar 56 is connected to the frame of batt former A in order to support the complete fan assembly, and may be suspended at both ends from side walls 58*a* and 58*b*, respectively.

As can best be seen in FIG. 1, flow directing means is provided by a clevis mounted turnbuckle 60 connected between pivotably mounted fan support frame 55 and a front splash plate 62, which is fixed with respect to the frame of batt former A. Thus, by turning the turnbuckle, the angle of incidence "a", between the axis of the fan's exit (line) 64 and back splash plate 66, may be readily adjusted to any desired operating value. A plenum means is provided by a spray chamber B defined by surfaces of top plate 69, front splash plate 62, back splash plate 66, and side plates 58*a* and 58*b*. The spray chamber is provided to receive the very high velocity jet of conveying air and finely opened fibers being flung from fan 52. This jet passes through a second flexible connector 70, through an inlet hole 71 (shown darkened in FIG. 1 and dotted in FIG. 2) which is cut in front splash plate 62. A batt forming chamber C, located below spray chamber B, includes front and back screen assemblies, shown generally at 72 and 74 respectively, side plates 58*a* and 58*b* and batt feed rolls 76*a* and 76*b*. These rolls deliver compacted batt 10 to card feed roll 12. Fiber compacting means for compacting fibers to form the batt includes static pressure P1 acting on the top of the fiber column in batt formation chamber C. Front (first) and back (second) screen assemblies 72, 74 define air separation means for separating the fibers from the air flow transporting them. The air separates through the screens to deposit the fibers into the fiber compacting chamber C.

As the fluidized mixture jet strikes back splash plate 66, there is a violent collision and the momentum of the fibers causes them to spray about in all directions at once. Many of the fibers ricochet almost instantly down into, and across the full width of, batt forming chamber C. Another portion of the fibers seem momentarily "stunned" by the impacts with the various walls and appear to float for brief instants in the turbulent eddies existing within spray chamber B. However, in the next instant, they may be driven violently downward toward any "un-blocked" area which may occur momentarily at either of the screens. The actions occurring within spray chamber B can best be described as, simply, organized chaos. However, the process is surprisingly self-levelling and self-correcting.

It appears that by piling, or washing, fibers slightly higher up side plates 58*a* and 58*b* than the elevation of the fiber column existing near the center portion of batt forming chamber C by using the flow directing means, the sidewall fibers have a longer "residence time" within the batt forming chamber. Since all the fibers within the batt forming chamber are acted upon by the same high static pressure P1, the increased packing work caused by the higher "residence time" tends to compensate for the undesired effects of the sidewall friction on the batt formed.

Figure 4:
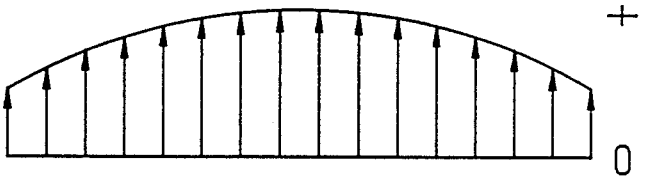

With the present invention it has been found that if the angle of incidence "a" is set at approximately 90 degrees, then the cross-direction density profile appearing in formed batt 10 takes the form illustrated by FIG. 4. A domed profile is produced which is heavy in the center and light at the edges. As mentioned supra, such a density profile is typically characteristic of most prior devices.

Figure 5:
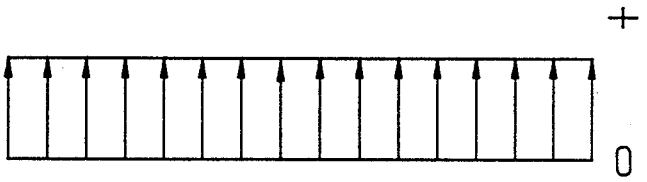

It has been further found that if the angle of incidence "a" is set in the approximate region of 50 to 80 degrees, then the cross-direction density profile of formed batt 30 can be made to take on the form illustrated by FIG. 5. An essentially constant density across the full width of the batt is produced.

Figure 6:
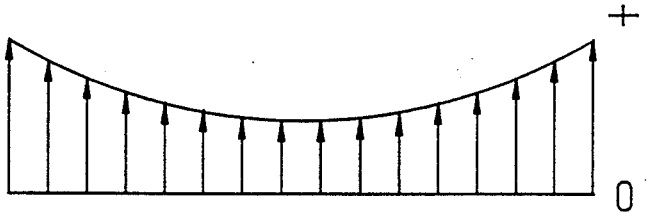
FIGS. 4, 5, and 6 are schematic representations of either various density profiles which may exist across the width of a fibrous batt, or various airstream velocity profiles which may exist across the width of an air channel.

Further, if the angle of incidence "a" is set in the approximate region of less that 50 degrees, then the cross-direction density profile of formed batt 10 can be made to take on the form illustrated by FIG. 6. A dished shape which is light toward the center and heavy at the edges is produced.

Thus, by merely changing the angle of incidence "a" it is possible to easily custom tailor the cross-direction density profile, as desired, to meet the special needs of the carding machine and/or the needs of any subsequent process which follows the carding machine, e.g. a web spreader for making a non-woven product. Clearly, this simple mechanism overcomes many of the disadvantages suffered by prior art.

Referring again to FIG. 1, if back splash plate 66 were hingably mounted at its lower edge (or broken into two parts, with a bottom first part rigidly fixed to the side walls 58*a* and 58*b* and a top second part hingably mounted atop the first), then fan 52 could be fixed. The angle of incidence "a" of the jet of fluidized mixture could then be varied by tilting the modified splash plate toward or away from the axis (line) 64 of the jet. One may alter the angle of incidence either way as well as others which become apparent after having been taught the advantages of the present invention. A pivoted fan 52 has been shown as the preferred embodiment because of the advantages of more easily sealing the system with respect to the room or ambient pressure. It should be borne in mind that the present invention contemplates being able to use a much higher stock packing pressure (static pressure p1), than is practical in the classic prior art. This enhances the uniformity of the density, both running-direction and cross-direction, of the batt which is formed. Consequently, sealing integrity is quite important.

Likewise, those skilled in the art will readily appreciate that the air knife capability to doff a finely toothed opener roll will also doff a coarsely toothed roll, of the type used in the prior art, because the latter has additional centrifugal forces to aid in the doffing action. This ability to operate batt former A with either type roll is advantageous as there are some types of fibers which can be "over-worked" by the intense opening capabilities provided in batt former A. However, with most common types of fiber, intense opening is preferred.

Preferably acceleration channel 30 should be oriented such that a very substantial portion of the highly organized airflow of the air knife jet passes through the teeth 28*a* (or pins) carried on the surface of opening roll 28, in order to enhance the doffing action.

Figure 7:
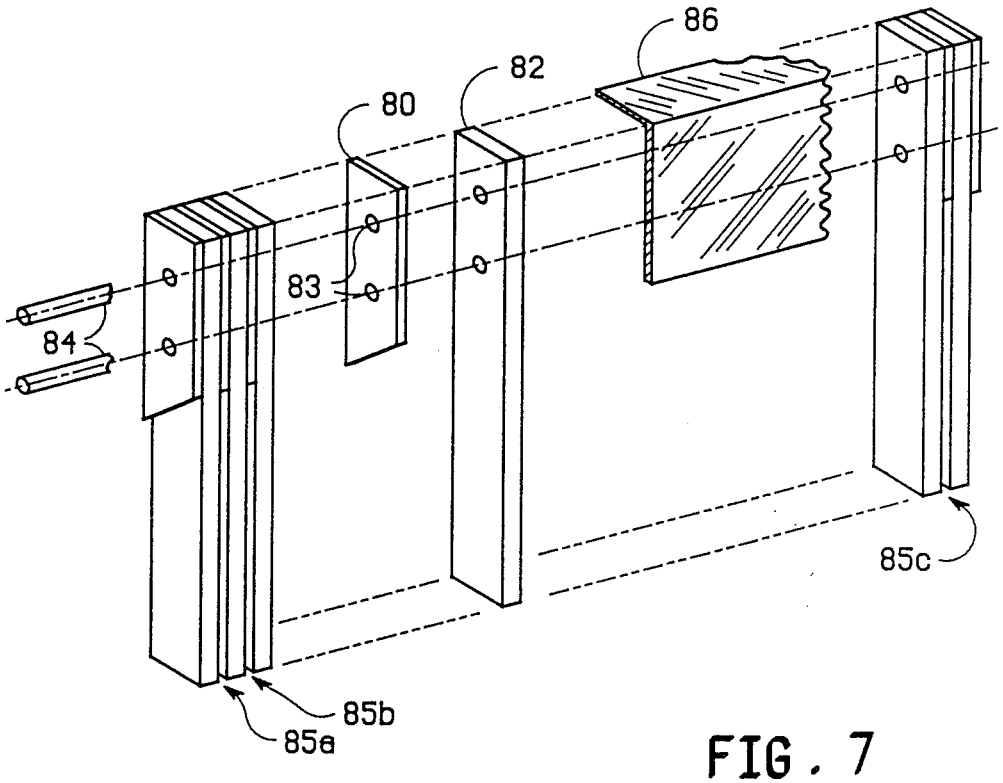
FIG. 7 is a schematical pictorial representation showing the construction of the back screen assembly 74, as would be seen from inside batt forming chamber C.

FIG. 7 is an exploded pictorial representation of a preferred embodiment of the construction of screen assemblies 72 and 74. FIG. 7 represents a view of back screen assembly 72, as would be seen from within batt forming chamber C. A plurality of thin short spacer bars, such as 80, are alternately laminated, or sandwiched, with a plurality of longer finger bars, such as 82. All bars are provided with two holes 83 which are spaced an equal distance apart and two dowel rods 84, which provide alignment and structural support, are passed through alignment holes 83. A sufficient number of spacer bars and finger bars are selected so that the resulting laminated structure spans the width between the inside surfaces of side plates 58*a* and 58*b* (the inside working width of batt former A). With this construction, a plurality of narrow air slots, such as 85*a*, 85*b*, . . . 85*c* exist between adjacent finger bars. Naturally, the width of each air slot, or passage, is determined by the thickness of the spacer bars used.

An L-shaped wrapper plate 86, having a length equal to the inside width of batt former A, is fastened to the laminated screen assembly. Wrapper plate 86 serves as a shield to prevent the tiny fibers from becoming lodged within the numerous joints existing between the various laminations. The flowing fibers merely "see" a very smooth surface.

Screens constructed according to FIG. 7 provide a relatively thick deep wall through which the air slot passages form long shallow flow paths. These keep the air currents flowing in an organized manner and this greatly reduces the turbulence and swirls which can spin fibers to form detrimental neps. Such construction offers significant advantages over the thin shallow perforated walls proposed by the prior art. Thick wall fiber condensing screens are particularly well suited for use with fibers in the highly liberated state contemplated by the present invention, because with a much higher number of individual fibers flowing freely about there is a much higher probability that some of their loose ends will either project into, or be drawn into, the exhausting air passages. With the much larger tufts used in prior art devices, most of the fiber ends are tied-up within each of the globs of fiber and only those fuzzing off from the surfaces of the globs are subject to projection into the exhausting air passages. Not only are thick wall screens better suited for handling highly liberated individual fibers, but they are also better suited for handling the globbier stock characteristic of prior art batt formers as well.

Construction of the front screen assembly 72 can take the same format as just described for the back screen assembly 74. However, with the present invention it is contemplated to either use spacer bars having a shorter length for the front screen than those used for the back screen, or to raise the elevation of the front screen relative to the back screen, so that the size of the "un-blocked" air slots of the front screen is greater than the "un-blocked" air slots of the back screen (study FIG. 1 carefully). The taller "open" air slots, above the height of the stock column in the batt forming chamber at the front screen provides a means for creating a lower static pressure drop across the front screen. Because the air exhausted through the front screen must follow a longer and more circuitous path before reaching the acceleration channel 30, than the air exhausted through the back screen, it is highly desirable to have a lower pressure drop through the front screen. This ensures that sufficient energy is available to achieve the desired distribution of flows throughout the batt former A. By judicious selection of simple geometries, one can achieve the desired proportions of airflow through the two screen assemblies, by regulating the pressure drop occurring across each. The significance of this will become more apparent momentarily.

Figure 3:
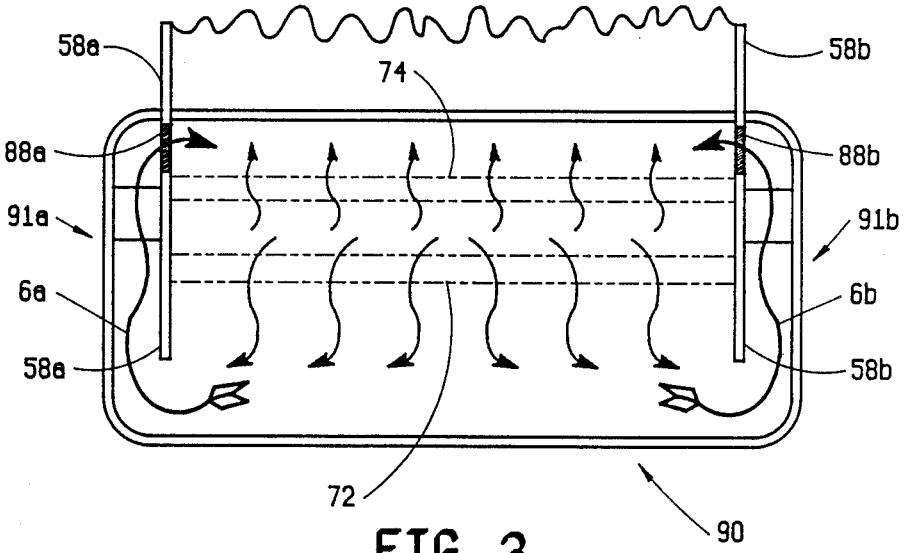
FIG. 3 is a schematic sectional plan view taken in the direction indicated by Section Line Arrows III—III, as shown on FIG. 2.

Means for distributing the front and back air flows to form a combined air flow with supercharged side regions will now be described. As can best be seen in FIG. 1, a portion of the conveying air, comprising part of the fluidized mixture, is exhausted through back screen assembly 74 along the path indicated by arrow 4. The channel means includes a dog-leg shaped turning plate 87 which turns the flow downward, across the full inside working width of batt former A, along a path indicated by arrows 4*a* through 4*f* (FIGS. 2 and 3) whereupon this airflow enters the inlet of acceleration channel 30. The remaining conveying air is passed through the front screen assembly 72 along the path indicated by arrow 5 (FIG. 1) and enters a front cross-flow channel indicated generally at 90 which forms part of the channel means between the air separation screens and fiber opening roll. As can best be seen in FIGS. 2 and 3, the air flowing into cross-flow channel 90 divides (as traced by arrows 6*a* and 6*b*) and flows through two side-flow channels, indicated generally at 91*a* and 91*b*, toward the rear of batt former A. After passing the vertical plane of back screen assembly 74, these two flows are turned inward and downward by deflector plates 92*a* and 92*b* which causes these flows to pass through two inlet ports 88*a* and 88*b* which are provided in side plates 58*a* and 58*b*, and then into the inlet of acceleration channel 30. In this manner, means for supercharging the energy level of the air entering the inlet of acceleration channel 30 is provided so that the air is "supercharged" in the regions of side plates 58*a* and 58*b*, which overcomes their sidewall friction effects. Otherwise, the cross-directional velocity profile of the air knife exiting the acceleration channel would be adversely affected. This air knife is used to "cut" or strip the finely opened fibers from the teeth of opening roll 28. In lieu of using 2 screens, a single screen may be used with air exit passages dimensioned at the sides to "supercharge" the side air flows.

It has been found that if little or no air is allowed to pass through the front screen assembly 72 to supercharge the sidewall regions then the resulting cross-direction velocity profile of the air knife takes on the appearance shown in FIG. 4. There is a high velocity near the center and lower nearer side walls 58*a* and 58*b*, which is the classical velocity profile of a single, two-dimensional flow channel. (It being understood that the profiles represented in FIGS. 4, 5, and 6 illustrate magnitudes only, and that the direction of the air knife is, of course, downward.) The critical velocity needed to doff opening roll 28 is represented by the minimum velocity appearing in the air knife profile. A profile such as FIG. 4 means that the only way to increase the velocity at the sidewalls, up to the required critical doffing value, is to increase the overall or total flow rate volume. This, imposes a non-optimum energy burden on fan 52 which must supply the energy dissipated by the frictional losses throughout the system, which are governed by the total volume of flow required. It has been further found that if a desired volume of flow is allowed to pass through the front screen assembly, to supercharge the regions near side walls 58*a* and 58*b*, then an air knife velocity profile such as shown by FIG. 5 results. This is an optimum running condition, because it represents a maximum doffing velocity using a minimum total air flow volume hence minimum energy losses. If an excessive amount of air is allowed to pass through the front screen, relative to the back screen, then the side wall regions can become over-supercharged resulting in a non-optimum air knife velocity profile, such as shown by FIG. 6.

With the present invention it has been found that a very good distribution of flows can be obtained by placing the elevation of the top of the air slots of the front screen assembly 72 approximately one inch (25 mm) higher than the top of the air slots of the back screen assembly 74. This assumes a nominal 38 inches (965 mm) working width batt former A. This provides the desired difference in pressure drops between the two screens. Those skilled in the art will recognize that the same effect can be obtained by placing the tops of the air slots of both screens at the same elevation, while using slightly wider spacer bars 80 to construct the front screen so that it has a lower pressure drop than the back screen. The purpose of a fan, such as 52, is to add energy to an air stream, and for a given inlet and exit velocity (constant kinetic energy level) the energy added takes the form of potential energy which is manifest as a rise in static pressure. Decelerating a flow within a channel causes an increase in static pressure, as the decreasing kinetic energy is converted to increasing potential energy. Conversely, a static pressure drop occurs whenever a flow is accelerated. However, frictional losses cause a drop in static pressure without a corresponding beneficial rise in velocity. With these known facts in mind, several key advantages of the present invention can become apparent over the prior art.

First, the cross-sectional flow area at the inlet of batt forming chamber C is the largest flow area anywhere throughout the system. Hence, the velocity is relatively low. This coupled with the fact that fan 52 is immediately upstream means that the static pressure P1 can be raised to a very high positive pressure, with respect to the room or ambient pressure. A very high positive pressure Pl permits very intense, enhanced packing of the fibers in the batt forming chamber C. This results in a more even density in formed batt 10 in the running-direction and the cross-direction, custom profiled as described above. Secondly, static pressure P2 is dropped to P3 due to the flow acceleration through converging acceleration channel 30. Also P3 is on the "suction" side of fan 52. Consequently, by selecting the appropriate geometry for plate 32, the static pressure in the region of opening roll 28 can be set to be either neutral, or slightly negative, with respect to the room or ambient pressure. This feature of the present invention is very advantageous. It prevents hazardous dust and fiber from being blown into either the room or the bearings of opening roll 28. Further, it prevents an adverse pressure situation from developing at fiber inlet opening 22. The importance of this latter point will become more apparent momentarily.

If desired, the static pressure in the region of opening roll 28 can be made even more negative by simply swapping the positions of turning elbow 45 and fan 52 (FIG. 2). In this instance, some form of bracket would be needed to fasten elbow 45 to a pivoted support, like frame 55.

Figure 8:
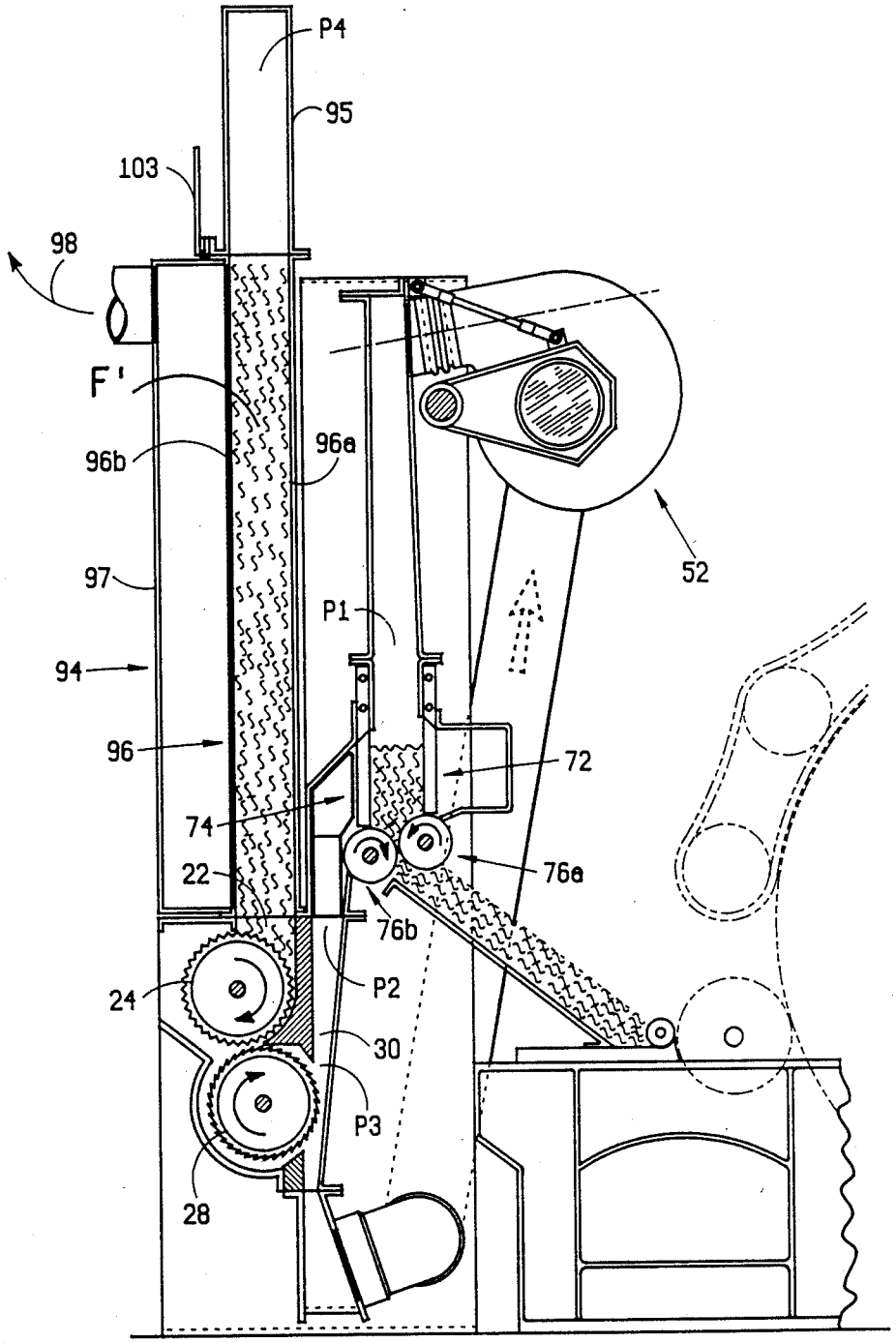
FIG. 8 is a schematic sectional side elevation view showing how a pneumatic transport means may be used to supply fibers to the present invention.

As can best be seen in FIG. 8 there is a fiber transfer assembly, shown generally at 94, connecting inlet opening 22 of batt former A to a main transport duct 95 which is supplying fiber from a central feeding point. A reserve chute 96, comprised of a front wall 96*a* and a perforated wall 96*b* contains a column of fibers F' which are fed through inlet opening 22 and thence to feed roll 24. The combined actions of gravity and the bleeding of a portion of the conveying air flowing down main transport duct 95 deposits tufts onto the stock column in the reserve chute. The air bled from transport duct 95 passes through perforated wall 96*b* and is collected within a capture hood 97 from which such air is ducted away to a filtration system as shown generally at 98. Static pressure P4 acts on the top of the stock column F' and compresses it downward through inlet opening 22, in a manner which is well known.

As mentioned above, the pressure condition at inlet opening 22 is either the same as the room air pressure or slightly negative with respect to it. As a consequence, static pressure P4 can be much lower than is needed by classic prior art systems. Hence, the energy burden imposed on the main transport fan is reduced. Furthermore, with a lower value needed for P4, there is less tendency for the main transport duct 95 to choke. This represents a significant improvement over the classic prior art.

Figure 10C:
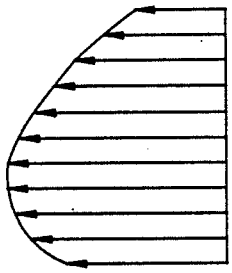
FIGS. 10*a* through 10*d* are schematic representations illustrating prior art.
Figure 10D:
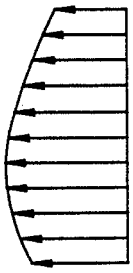
FIG. 10d PRIOR ART
Figure 10B:
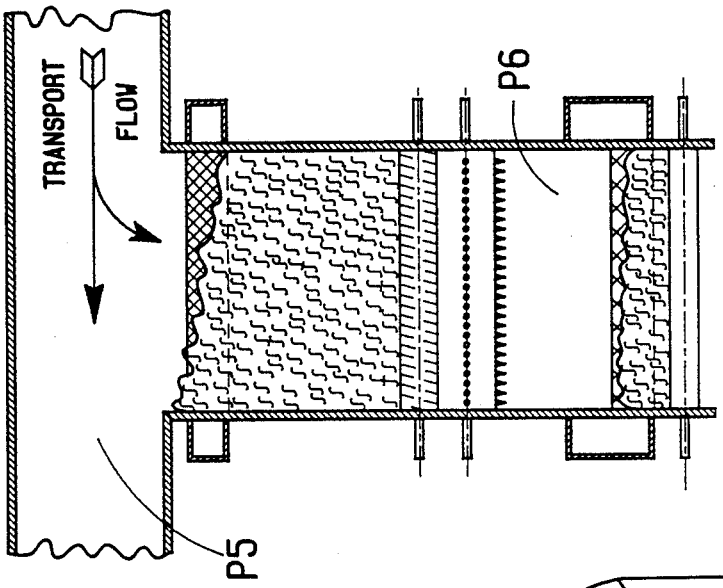
FIG. 10b PRIOR ART
Figure 10A:
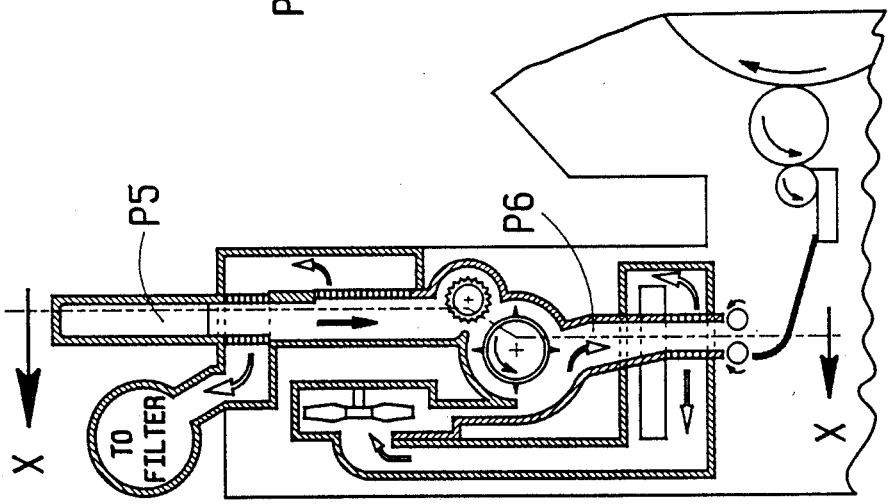
FIG. 10a PRIOR ART

Referring again to prior art FIGS. 10*a* and 10*b*, they show that static pressure P5 must greater than P6 in order to feed fibers into the feed roll. Since there is an upper limit as to how high static pressure P5 can be raised without nuisance choking in the main transport duct, A limit is imposed on how high the value of static pressure P6 can be raised to pack the fibers in the lower batt compacting chamber. Referring to FIG. 8, according to the present invention, static pressure Pl can be raised to a very high value, for enhanced fiber compaction, without adversely interfering with the transport static pressure P4. Furthermore, none of the fans 52, operating in a group of batt formers A, "fight" against the main transport fan. Clearly, the present invention offers significant advantages over the prior art from a pressure balance sensitivity and system fiber feeding reliability point of view, as well as an enhanced fiber compaction potential, due to a higher permissible static pressure Pl.

While FIG. 8 shows fiber being supplied to batt former(s) A using a "transverse" fiber distribution system (cards arranged, side-by-side), it will be readily recognized that batt former(s) A can likewise be fed fiber using a "longitudinal" fiber distribution system (cards arranged, end-to-end). Using a "transverse" fiber distribution system, the density profile across inlet opening 52 may be skewed to one side or the other of batt former A. However, this is inconsequential because the fiber column is completely destroyed by opening roll 28 and reassembled downstream in batt forming chamber C, in a controlled manner, to yield a desired exiting cross-directional density profile.

Figure 9:
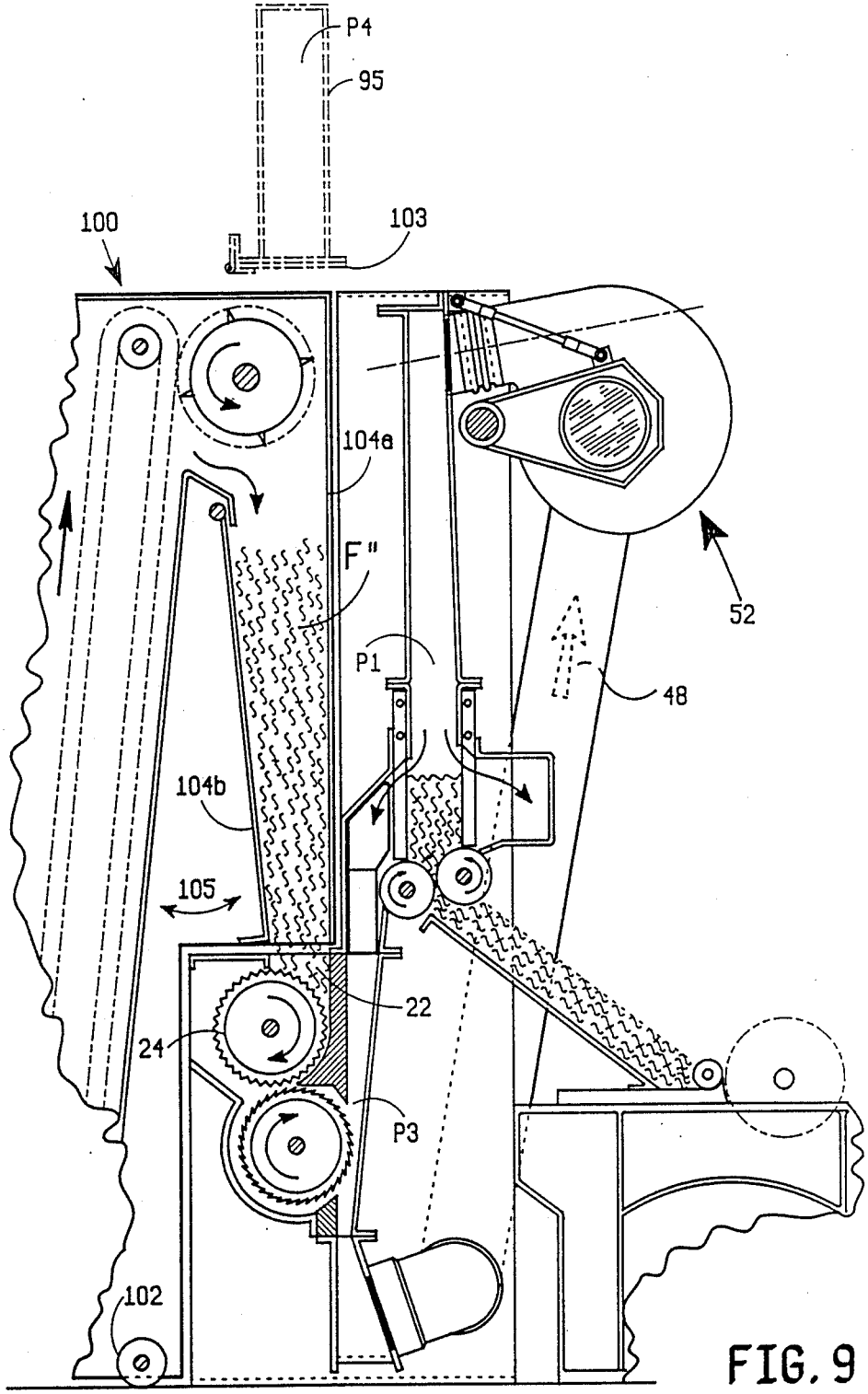
FIG. 9 is a schematic sectional side elevation view of a hopper feeder being used as a means to supply fibers to the present invention.

As can best be seen in FIG. 9, fiber transfer assembly 94 (FIG. 8) can be simply slid out of the way (for example, on a simple track means—not shown), and replaced by a conventional hopper feeder, shown generally at 100, which has been rolled into position by means of wheels 102 in order to supply fiber to batt former A. In this embodiment, a hinged cover plate 103 fastened to main transport duct 95, may be closed to seal the main transport duct as it passes above the batt former A. Consequently, the common fiber supply system distributing fibers via transport duct 95 can continue to feed fiber to various batt formers, located on either side of the illustrated batt former A, without interference. The changeover from one method of fiber supply to the other can be accomplished easily and rapidly with a minimum of down-time.

In hopper feeder 100, a column F″ of fiber is supplied to inlet opening 22 by means of a reserve chute comprised of a front wall 104*a* and a back wall 104*b*. Back wall 104*b* may take the form of a conventional spanker plate and be reciprocated back and forth in the directions of arrow 105. As mentioned above, the static pressure occurring at inlet opening 22 is neutral to slightly negative and, therefore, cannot adversely interfere with the feeding of fibers into feed roll 24. Referring to FIG. 9 and prior art FIGS. 10*a* and 10*b*, it can be seen that fibers in the reserve chute formed by walls 104*a* and 104*b* of hopper feeder 100 could not be fed into the prior art feed roll. The high static pressure P6 existing in the prior art devices would simply blow the fiber up and away from the feed roll. This combination of fiber supply methods is impractical.

Hopper feeder 100 represents the most flexible fiber distribution system known (individually, card-to-card), since batt former A can accept fibers from either "transverse" or "longitudinal" pneumatic fiber distribution systems with equal ease, and since the change-over from any method of fiber supply to the other is readily accomplished, it is clear that the present invention offers a universal feeding module having broad processing applications. The present invention allows textile mills the opportunity to reap the increased profits offered by the "just-in-time" and "quick response" operating concepts, and without the disadvantages heretofore encountered.

Figure 11:
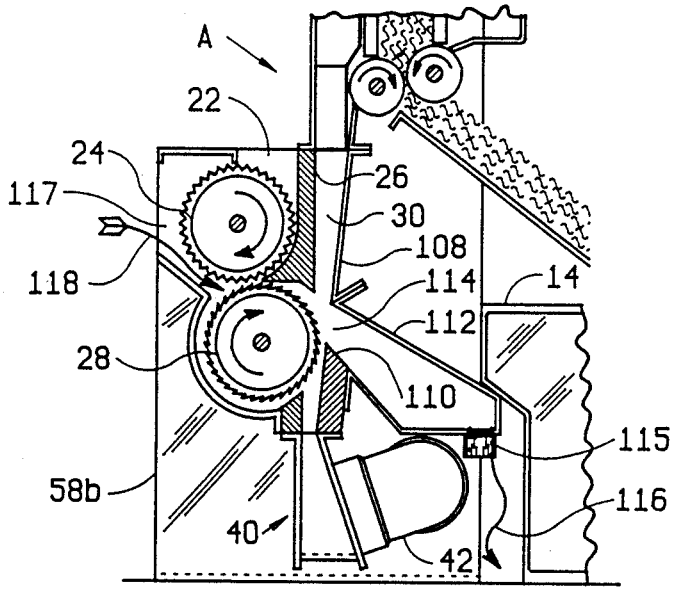
FIG. 11 is a schematic side elevation view showing a way the present invention may be adapted for additional cleaning of the fibers being processed.

Referring now to FIG. 11, front plate 32, comprising one wall of acceleration channel 30 (FIG. 1) has been replaced by a short front plate 108, a mote knife 110, and a mote box 112, all of which span the inside working width of batt former A. Trash particles, such as pieces of leaf, stalk, dirt, "pepper trash", and other impurities known to accompany certain textile fibers, loosened by the intense "opening" action of opening roll 28 may be hurled by centrifugal forces (due to their larger mass) through inlet opening 114 into mote box 112. Mote knife 110 may also have substituted for it a plurality of mote knives comprised of triangular shaped bars, each having a sharp edge disposed to engage the fibers in transit. If desired, a pneumatic connection to mote box 112, such as illustrated by a pipe means 115, may be made whereby a relatively small amount of airflow, either intermittent or continuous may be used to suck the trash from mote box 112. This airflow conveys the same to a filtration system by a ducting means, such as indicated generally at 116. In this case, the air removed from the recirculating fiber conveying loop of batt former A, is easily replenished by room air drawn in through inlet opening 117, as indicated generally at 118.

In either case, the static pressure situation existing at stock inlet opening 22 again is not adversely affected. The present invention is always "pneumatically referenced" to the room static pressure by means of inlet opening 117. This offers significant operating advantages over the prior art.

An improved carding machine, which can run at superior production rates, results when the present invention is incorporated with a conventional carding machine, because the opening and cleaning potential of two independent licker-in cylinders, both having tight nip points to work from, is available. As applied to a carding machine, the present invention provides a superior combination to prior art systems, which added either one or two licker-in cylinders in series with, and downstream of, the regular licker-in cylinder. In this latter case, only one tight nip point is available to work from (at the regular licker-in). The "opening" action of the second or third licker-ins is far less efficient because the fiber restraining forces each works against is merely the fiber/tooth entanglement forces existing on the surface of the slower moving preceding roll, and the inertial forces involved in snatching fibers from it. Since the angle of the teeth of the previous roll is pointed in the same direction as the snatching forces on the following roll, the forces of fiber restraint are probably ten orders of magnitude lower than when a tight nip point, such as a feed roll/feed plate combination, is used. It can thus be seen that other expedients and objects of the present invention also provide advantageous in combination with a carding machine such as accurate control of the fiber profile in batt 10 and fiber separation feed roll 12 of the carding machine providing uniform card production. Consequently, the present invention provides substantial advantages over the prior art.

It can thus be seen that an advantageous air circulation loop can be provided for a batt former wherein static pressures can be established as expedients for enhanced fiber compaction, diverse fiber feeding, fiber opening, fiber cleaning, and fiber distribution in the fiber compacting chamber for forming and feeding fibers to a carding machine having a desired cross-directional profile. This air circulation loop advantageously includes air propelling means 52, plenum means B, air separation means 72, 74, deflecting plate 87, side channels 91*a*, 91*b*, acceleration channel 30, and duct means 90. Fiber compacting chamber C and fiber opening roll 28 are disposed in working relation to the air circulation loop. The air recirculates in the air circulation loop without exhausting the transport air back into the environment resulting in decreased energy consumption for the air fan.

While a preferred embodiment of the invention has been described using specific terms, such description is for illustrative purposes only, and it is to be understood that changes and variations may be made without departing from the spirit or scope of the following claims.

What is claimed is:

1. Textile apparatus for forming a textile fiber batt having a prescribed cross-directional density profile and a high degree of fiber separation, said apparatus comprising:

fiber supply means for supplying textile fibers;

an air circulation loop;

fiber opening means receiving fibers from said fiber supply means for loosening and separating said fibers to produce opened fibers and for introducing said opened fibers to said air circulation loop;

air propelling means for creating an air flow which transports said opened fibers through said air propelling means and along said air circulation loop, said air propelling means being disposed in said air circulation loop downstream of said fiber opening means in the direction of said air flow;

fiber compacting means for forming a compacted batt of said opened fibers and discharging said compacted batt from said apparatus; and air separation means for separating substantially all of said opened fibers from said air flow and preventing said opened fibers from recirculating around said air circulation loop, said air separation means being disposed in said air circulation loop downstream of said air propelling means in the direction of said air flow and near said fiber compacting means.

2. The apparatus of claim 1 including plenum means for distributing said opened fibers in said textile apparatus to provide said prescribed cross-directional density profile in said compacted batt.

3. The apparatus of claim 2 wherein said plenum means includes a spray chamber having a splash plate and flow directing means for distributing said opened fibers against said splash plate to create said prescribed cross-directional density profile using momentum of said opened fibers and currents of said air flow.

4. The apparatus of claim 3 wherein said flow directing means includes angle adjusting means for adjusting at least one angle of incidence between said splash plate and said flow directing means to enhance the distribution of said opened fibers ins said textile apparatus.

5. The apparatus of claim 4 wherein said angle adjusting means includes a fan outlet which is adjustable so as to vary the inclination of the direction of said air flow against said splash plate.

6. The apparatus of claim 4 wherein said angle adjusting means includes a pivotal fan having an outlet, an inlet through which fibers flow into said plenum means, and flexible means attaching said fan outlet to said inlet so that when said fan is pivoted, the angle of said air flow delivered by said fan is changed relative to said splash plate.

7. The apparatus of claim 2 including compensating means for negating the effects of friction between opposing interior side walls of said plenum means and said opened fibers to facilitate formation of said prescribed cross-directional density profile of said compacted batt.

8. The apparatus of claim 2 including channel means for directing said air flow and including a first static pressure in said plenum means, a second static pressure near the entrance of said channel means, and said first static pressure being greater than said second static pressure.

9. The apparatus of claim 8 including a third static pressure in said channel means adjacent said fiber opening means being either generally equal to, or less than, ambient or atmospheric.

10. The apparatus of claim 1 wherein said air separation means includes at least one screen having a plurality of air exit passages, said exit passages being adjustable in at least one dimension to provide a prescribed air velocity profile through said screen or screens.

11. The apparatus of claim 10 wherein said air separation means includes a first screen and a second screen, and including means for creating a lower static pressure drop across said first screen than said second screen in order to govern the proportion of air passing through said first screen relative to said second screen.

12. The apparatus of claim 11 wherein said means for creating a lower static pressure drop across said first screen than said second screen includes air exit passages of said first screen having a larger net flow area than air exit passages of said second screen.

13. The apparatus of claim 11 wherein said means for creating a lower static pressure drop across said first screen than said second screen includes disposing air exit passages in said first screen farther upstream in said air flow than air exit passages in said second screen.

14. The apparatus of claim 10 wherein said exit passages have substantially parallel opposing walls and have a dimension in a direction of said air flow which is substantially greater than the dimension of said exit passages in a cross-direction of said air flow to facilitate passage of air with minimized turbulence and degradation of the quality of said fibers.

15. The apparatus of claim 1 wherein said air propelling means is positioned upstream of said fiber compacting means to create a super atmospheric fiber compactor static pressure.

16. The apparatus of claim 1 wherein said fiber opening means includes a clothed opening roll having wire teeth for loosening and opening textile fibers.

17. The apparatus of claim 16 including air knife means for utilizing said air flow as an air knife which cuts through said wire teeth for enhanced doffing of said opened fibers from said opening roll.

18. The apparatus of claim 17 including air supercharging means for creating supercharged air flows near opposite ends of said air knife means to produce an optimum velocity profile across said air knife for doffing said opened fibers with a minimum of energy.

19. The apparatus of claim 17 including channel means for guiding said air flow and including supercharging means for increasing the energy level at opposing side regions of said channel means in order to minimize sidewall friction effects in said channel means.

20. The apparatus of claim 19 wherein said channel means includes an acceleration channel for accelerating the flow velocity of said air knife.

21. The apparatus of claim 16 wherein said opening roll has teeth in a range of about 1 to 40 teeth per square inch over the working surface of said opening roll.

22. The apparatus of claim 1 including flow directing means for depositing greater amounts of fiber near opposite sides of said fiber compacting means, than deposited near the center of said fiber compacting means, which increases the residence time of fibers near opposing side walls of said fiber compacting means to reduce the effects of side wall friction.

23. The apparatus of claim 1 wherein said fiber supply means includes a supply inlet through which fibers pass to said fiber opening means, and a static pressure at said supply inlet which is either generally equal to, or less than, ambient or atmospheric.

24. The apparatus of claim 23 including a removable fiber supply module, and means for connecting said fiber supply module to said supply inlet of said fiber opening means to provide accommodation for connection of different fiber supply sources to said supply inlet.

25. The apparatus of claim 24 wherein said fiber supply module includes a textile hopper feeder connectable to said supply inlet.

26. The apparatus of claim 24 wherein said fiber supply module includes a substantially vertical textile chute feed connectable to said supply inlet.

27. The apparatus of claim 1 wherein said fiber opening means includes a fiber opening roll having working elements for loosening and separating said textile fibers to create opened fibers and for dislodging impurities therefrom, and including cleaning means disposed in relation to said fiber opening means for removing and receiving said impurities.

28. The apparatus of claim 27 wherein said cleaning means comprises a mote knife disposed across an inside working width of said fiber opening roll; and a mote box for receiving said impurities.

29. The apparatus of claim 28 wherein said mote box includes an opening disposed adjacent said fiber opening roll and in a region near which said opened fibers are doffed.

30. The apparatus of claim 27 including:

channel means disposed upstream of said fiber opening roll, with respect to the direction of said air flow, for guiding said air flow;

plenum means disposed upstream of said fiber compacting means, with respect to the direction of said air flow, for distributing said opened fibers near said fiber compacting means; and supercharging means for supercharging said air flow at opposing side regions of said channel means to provide an optimum velocity profile for said air flow to doff said opened fibers across a working width of said fiber opening roll with a minimum of energy.

31. The apparatus of claim 30 wherein said channel means includes an acceleration channel to accelerate said air flow for enhanced doffing of said fiber opening roll.

32. The apparatus of claim 27 wherein said air circulation loop includes a doffing region at which said opened fibers are introduced to said air circulation loop, and wherein said air propelling means is disposed in said air circulation loop so as to cause a static pressure at said doffing region which is either generally equal to, or less than, ambient or atmospheric.

33. The apparatus of claim 1 for compensating for frictional effects, wherein said apparatus includes:

plenum means disposed upstream, with respect to the d of said air flow, of said fiber compacting means for distributing said opened fibers to said fiber compacting means;

channel means disposed downstream, with respect to the direction of said air flow, of said air separation means for guiding said air flow in a portion of said air circulation loop; and supercharging means for distributing said air flow to cause supercharged side air flows near opposing side regions of said channel means to compensate for sidewall friction and provide a desired air velocity profile across a working width of said fiber opening means.

34. The apparatus of claim 33 including:

flow directing means for distributing said opened fibers in a cross-directional profile in said fiber compacting means at opposing sides to increase the residence time of fibers along side regions of said fiber compacting means and compensate for sidewall friction.

35. The apparatus of claim 33 wherein said channel means includes at least one deflection wall for deflecting a portion of said air flow exiting said air separation means as a separated air flow and an acceleration channel receiving said separated air flow to accelerate said separated air flow.

36. The apparatus of claim 33 wherein said air separation means includes first and second screens for separating said air flow into first and second air flows, said channel means including opposing side channels between which said first air flow is divided and subsequently combined with said second air flow in said channel means to provide said supercharged side air flows.

37. The apparatus of claim 36 including means for creating a lower static pressure drop across said first screen than said second air screen to facilitate relative distribution of said first and second air flows.

38. The apparatus of claim 1 comprising:

plenum means disposed upstream, with respect to the direction of said air flow, of said fiber compacting means for distributing said opened fibers to said fiber compacting means;

channel means disposed downstream, with respect to the direction of said air flow, of said air separation means for guiding said air flow along a portion of said air circulation loop;

at least one separated air flow exiting said air separation means;

a fiber opening roll, associated with said fiber opening means, said fiber opening roll having teeth for opening or separating textile fibers to produce said opened fibers and dislodging impurities therefrom;

air knife means for creating a high velocity air knife which passes through the teeth of said opening roll to enhance the doffing of said opened fibers therefrom; and cleaning means disposed in relation to said fiber opening means for removing impurities separated from said opened fibers by the action of said fiber opening roll and for receiving said impurities.

39. The apparatus of claim 38 wherein said cleaning means comprises a mote knife disposed across an inside working width of said fiber opening roll; and a mote box for receiving said impurities.

40. The apparatus of claim 38 including supercharging means for supercharging said separated air flow at regions near opposing side walls of said channel means to optimize said air knife to doff said fibers with minimum energy.

41. The apparatus of claim 40 wherein said supercharging means includes said air separation means separating said air flow into first and second air flows, means for combining said first and second air flows to create supercharged regions at opposing sides, of said channel means.

42. The apparatus of claim 41 wherein said channel means includes a deflection means for deflecting said first and second air flows and an acceleration channel receiving said deflected air flows to accelerate said air flows.

43. The apparatus of claim 38 including a supply inlet through which fibers are passed to said fiber opening means, said supply inlet operating under a condition of being either generally equal to, or less than, ambient or atmospheric pressure.

44. The apparatus of claim 38 including flow directing means for directing a flow of fiber-laden air at a desired angle to a splash plate of said plenum means to thereby deposit fibers in said compacting means as to increase the residence time of fibers along side regions of said fiber compacting means providing a desired cross-direction density profile for said compacted batt.

45. The apparatus of claim 1 comprising:

channel means disposed downstream, with respect to the direction of said air flow, of said air separation means for guiding said air flow along a portion of said air circulation loop;

supercharging means for causing supercharged air flow near opposing sidewalls of said channel means to compensate for the effects of sidewall friction and facilitate the doffing of said opened fibers from said fiber opening means with minimum energy; and flow directing means for controlling the distribution of said opened fibers near said fiber compacting means thereby causing enhanced formation of said compacted batt.

46. Textile apparatus for forming a textile fiber batt having a prescribed cross-directional density profile and a high degree of fiber separation comprising:

air propelling means for creating an air flow;

fiber supply means for supplying textile fibers for formation into said fiber batt;

fiber opening means receiving said textile fibers from said fiber supply means for loosening and separating textile fibers to produce opened fibers for introduction into said air flow;

fiber separation means for separating said opened fibers from said air flow;

fiber compacting means receiving said opened fibers separated from said air flow for compacting said opened fibers to form said fiber batt and discharging said batt from said apparatus;

plenum means for distributing said opened fibers near said fiber compacting means;

channel means for guiding said air flow to create a high velocity air knife for doffing opened fibers from said fiber opening means; and supercharging means for distributing said air flow to form supercharged side air flows at opposing side regions of said air flow in said channel means to compensate for sidewall friction and provide a desired air velocity profile across a working width of said fiber opening means for enhanced doffing of said opened fibers from said fiber opening means.

47. The apparatus of claim 46 wherein said supercharging means includes distributing said air flow into zones of higher static pressure near opposing side regions of said channel means than the static pressure near the medial region of said channel means.

48. The apparatus of claim 46 wherein said supercharging means includes utilizing the geometry of said channel means to facilitate distribution of said air flow into zones of higher static pressure near opposing side regions of said channel means than the static pressure near the medial region of said channel means thereby compensating for sidewall friction.

49. The apparatus of any one of claims 1, 3–4, 9–12, 17–19, 22–26, 33, and 46 including a carding machine having a carding cylinder for producing a carded web, and feed means for feeding fibers from said compacted batt to said carding cylinder across a width of said carding cylinder.

50. Textile apparatus for forming a textile fiber batt having prescribed cross-directional density profile and a high degree of fiber separation comprising:

fiber supply means supplying textile fibers for formation into said fiber batt;

an air circulation loop;

air propelling means for creating an air flow in said air circulation loop;

fiber opening means receiving said textile fibers for loosening and separating textile fibers to produce opened textile fibers for introduction into said air flow;

fiber separation means for separating said opened fibers from said air flow creating a separated air flow;

fiber compacting means for receiving said opened fibers separated from said air flow and compacting said opened fibers into said fiber batt;

plenum means disposed upstream of said fiber compacting means in said air circulation loop for distributing said opened fibers to said fiber compacting means;

channel means disposed downstream of said fiber separation means for guiding said air flow along a portion of said air circulation loop; and supercharging means for distributing said air flow to form supercharged side air flow at opposing side regions of said air flow in said channel means to overcome sidewall friction and provide a desired air velocity profile across a working width of said fiber opening means.

51. The apparatus of claim 50 including:

flow directing means for distributing said opened fibers in a cross-directional profile in said fiber compacting means at opposing sides to increase the residence time of fibers along side regions of said fiber compacting means and compensate for sidewall friction.

52. The apparatus of claim 50 wherein said channel means includes a deflection wall for deflecting said separated air flow and an acceleration channel receiving said deflected separated air flow to accelerate said separated air flow.

53. The apparatus of claim 50 wherein said air separation means includes first and second screens for separating said air flow into first and second air flows, said channel means including opposing side channels between which said first air flow is divided and combined with said second air flow at an inlet of said acceleration channel to provide said supercharged side air flows.

54. The apparatus of claim 53 including means for creating a lower static pressure drop across said first screen than said second air screen to facilitate relative distribution of said first and second air flows.

55. Textile fiber processing apparatus for producing a carded web including textile fibers which have been separated and cleaned to a high degree at a high production rate, comprising:

a carding machine having a carding cylinder for producing a carded web and feed means for feeding fibers to said carding cylinder across a width of said carding cylinder;

a batt former having a fiber compacting chamber and mans for discharging a compacted fiber batt from said batt former;

air propelling means for creating an air flow which transports opened fibers as a fiber-laden air flow;

plenum means disposed upstream of said fiber compacting chamber for distributing said fiber-laden air flow;

air separation means disposed near said fiber compacting chamber for separating air from said fiber-laden air flow so that said fibers are deposited in said fiber compacting chamber and a separated air flow is created;

channel means disposed downstream of said fiber compacting chamber for receiving said separated air flow;

fiber opening means including a fiber opening roll having teeth for opening said fibers to produce opened fibers for introduction into said separated air flow;

air knife means for creating an air knife which passes through said teeth of said fiber opening means to doff said opened fibers and introduce them into said separated air flow for transportation; and cleaning means disposed in relation to said fiber opening means for removing impurities separated from said opened fibers by the action of said fiber opening roll and for receiving said impurities.

56. The apparatus of claim 55 wherein said cleaning means comprises a mote knife disposed across an inside working width of said fiber opening roll; and a mote box for receiving said impurities.

57. The apparatus of claim 55 including supercharging means for supercharging said separated air flow at regions near opposing side walls of said channel means to optimize said air knife to doff said fibers with minimum energy.

58. The apparatus of claim 57 wherein said supercharging means includes said air separation means separating said air flow into first and second air flows, means for combining said first and second air flows to create supercharged regions at opposing sides of said channel means.

59. The apparatus of claim 58 wherein said channel means includes a deflection means for deflecting said first and second air flows and an acceleration channel receiving said deflected air flows to accelerate said air flows.

60. The apparatus of claim 55 including a supply inlet through which fibers are supplied to said fiber opening means, said supply inlet operating at either generally equal to or less than ambient or atmospheric pressure.

61. The apparatus of claim 55 including adjustable air flow directing means for directing a flow of fiber-laden air at a desired angle to a splash plate of said plenum means to thereby deposit fibers in said compacting chamber so as to increase the residence time of fibers along side regions of said fiber compacting chamber providing a desired cross-direction density profile for said fiber batt fed to said feed means of said carding machine.

62. Textile apparatus for forming a textile fiber batt of the type having opening means for opening and separating textile fibers to produce opened fibers; fiber supply means for supplying said textile fibers to said fiber opening means; fiber compacting means for compacting said opened fibers; air separation means having a plurality of air passages for separating air from a fiber-laden air flow to create a separated air flow and deposit said opened fibers at said fiber compacting means; wherein said air separation means comprises:

at least one screen disposed in a cross-flow direction to a flow direction of said fiber-laden air flow;

said screen including a series of elongated finger bars spaced in said cross-flow direction alternately laminated with adjustable spacer means disposed between said finger bars for providing a desired spacing between adjacent finger bars;

said finger bars having opposed planar side surfaces extending in the flow direction of said separated air flow; and said planar surfaces having a dimension in the flow direction of said separated air flow passing through said screen substantially greater than a dimension of said air passages in said cross-flow direction to define deep, narrow exit air passages between adjacent finger bars which facilitate the orderly flow of exit air through said screen without degradation of said textile fibers.

63. The apparatus of claim 62 wherein said air separation means includes a first screen and a second screen, and means for creating a lower static pressure drop across said first air screen than said second screen.

64. The apparatus of claim 63 wherein said means for creating a lower static pressure drop across said first screen includes air exit passages in said first screen which initiate farther upstream in the air flow than exit passages in said second screen.

65. The apparatus of claim 62 wherein said adjustable spacer means includes spacer bars arranged between adjacent finger bars, and means for carrying an adjustable number of said spacer bars between said finger bars.

66. The apparatus of claim 65 wherein said finger bars terminate in free ends, and said spacer bars terminate short of said free ends of said finger bars to define said exit air passages.

67. The apparatus of claim 66 wherein said free ends of said finger bars are made to terminate on a common line and the distance from said common line to each respective terminal end of the alternately interposed spacer bars is made adjustable or variable thereby creating a plurality of variable length air exit passages which may be disposed across said screen in a desired fashion to govern the cross-directional distribution of said opened fibers delivered at said fiber compacting means.

68. The apparatus of claim 65 wherein said spacer bar terminate in slanted ends to guide said separated air flow.

69. The apparatus of claim 62 including air propelling means for creating an air flow to transport said opened fibers wherein said air propelling means is positioned between said fiber opening means and said fiber compacting means in the air flow direction.

70. A combination of a carding machine of the type having a main carding cylinder and feed means for feeding fibers to said main carding cylinder from which a carded web is produced, and a batt former for forming a compacted fiber batt which is fed to said feed means, wherein said batt former comprises:

a fiber supply means for supplying fibers for the formation of said fiber batt;

an air circulation loop;

air propelling means for creating an air flow which transports fibers in said air circulation loop;

a fiber compacting means for compacting fibers and discharging said fibers in the form of a compacted fiber batt to said feed means of said carding machine;

plenum means disposed in said air circulation loop upstream of said fiber compacting mans for distributing fibers near said fiber compacting means;

air separation means disposed in said air circulation loop near said fiber compacting means for separating fibers from said air flow to create a separated air flow and to deposit said fibers at said fiber compacting means;

channel means disposed in said air circulation loop downstream of said air separation means for receiving said separated air flow;

fiber opening means disposed near said channel means for receiving said fibers from said fiber supply means;

fiber cleaning mans disposed adjacent said fiber opening means for removing impurities from said opened fibers;

air supercharging means for forming supercharged air flow at opposing side regions of said channel means to form a desired velocity profile across a working width of said fiber opening means to uniformly doff said fiber opening means with minimum energy and introduce said fibers to said separated air flow; and flow directing mans for introducing said fiber-laden air flow into said plenum means at a desired angle establish a desired cross-directional distribution of said fibers in said fiber compacting means to overcome sidewall friction between said fibers and said fiber compacting means so that a fiber batt is presented to said feed means having a cross-directional profile which reduces the creation of light edges on said carded web produced by said carding machine.

71. A method for forming a textile fiber batt of compacted textile fibers having a prescribed cross-directional density profile and high degree of separation comprising:

creating an air flow in an air circulation loop;

opening and loosening textile fibers at a fiber opening zone to create opened fibers and introducing said opened fibers into said air flow at a pressure generally equal to or less than ambient or atmospheric pressure;

separating said opened fibers from said air flow near a fiber compacting zone to prevent said opened fibers from recirculating around said air circulation loop;

compacting said opened fibers to form said compacted fiber batt;

discharging said compacted fiber batt; and creating said air flow between said fiber opening zone and said fiber compacting zone in the direction of said air flow to create a high static pressure at said fiber compacting zone for enhancing compaction of said opened fibers.

72. The method of claim 71 including distributing said fibers in said fiber compacting zone in such a way as to establish a longer residence time of said fibers at opposing sides of said compacting zone than fibers in the medial portion of said compacting zone to compensate for friction.

73. The method of claim 71 comprising:

opening said textile fibers with an opening roll having teeth to produce opened fibers;

holding said textile fibers by a nip as they are engaged by said teeth;

creating an air knife across the width of said opening roll in said air circulation loop; and passing said air knife through said teeth of said opening roll to doff said opened fibers and introduce said opened fibers into said air circulation loop such that said opened fibers are caused to pass through the said air flow.

74. The method of claim 73 including supercharging air flows at side regions of said air knife to optimize energy utilization to form a velocity profile for said air knife across a working width of said opening roll for uniformly doffing said opened fibers across said working width with a minimum energy.

75. The method of claim 73 comprising:

cleaning said fibers by separating impurities from said opened fibers introduced into said air circulation loop.

76. The method of claim 75 including separating said impurities from said opened fibers by utilizing a mote knife disposed adjacent said opening roll.

* * * * *